US005755947A

United States Patent [19]

McElhanon et al.

[11] Patent Number: 5,755,947

[45] Date of Patent: May 26, 1998

[54] ADHESION ENHANCEMENT FOR UNDERPLATING PROBLEM

[75] Inventors: Robert W. McElhanon, Bryans Road, Md.; William K. Burns, Alexandria, Va.

[73] Assignee: The United States of America as represented by the Secretary of the Navy, Washington, D.C.

[21] Appl. No.: 594,957

[22] Filed: Jan. 31, 1996

[51] Int. Cl.[6] ..... C25D 5/02

[52] U.S. Cl. ..... 205/118; 205/122; 205/183

[58] Field of Search ..... 205/118, 122, 205/123, 183, 186

[56] References Cited

U.S. PATENT DOCUMENTS

| | | | |
|---|---|---|---|
| 3,644,184 | 2/1972 | Smith | 205/266 |
| 4,988,413 | 1/1991 | Chakravorty | 205/118 |
| 5,098,860 | 3/1992 | Chakravorty | 437/195 |
| 5,470,693 | 11/1995 | Sachdev | 430/315 |

*Primary Examiner*—John Niebling
*Assistant Examiner*—Brendan Mee
*Attorney, Agent, or Firm*—Thomas E. McDonnel; George Kap

[57] ABSTRACT

Underplating between a metallic plating base and a photoresist deposited thereon can be reduced or eliminated by a method of fabricating a microstructure which includes the steps of:

(a) depositing a plating base on the adhesion layer;

(b) depositing on the plating base a sacrificial layer of a material that reduces or eliminates underplating on the plating base compared to underplating in absence of the sacrificial layer;

(c) depositing a photoresist on the sacrificial layer;

(d) exposing, developing and removing the exposed photoresist from the substrate to uncover a portion of the sacrificial layer;

(e) removing the sacrificial layer portion from the substrate to uncover a portion of the plating base; and (f) depositing a metallic material on the uncovered plating base under the influence of electrical current.

24 Claims, 1 Drawing Sheet

ADHESION ENHANCEMENT FOR UNDERPLATING PROBLEM

FIELD OF THE INVENTION

This invention pertains to improving adhesion between a metallic surface and a resist to reduce or prevent underplating or separation therebetween during electroplating.

DESCRIPTION OF THE BACKGROUND

This invention was inspired by the development of a three dimensional fabrication process for creating high depth-to-width aspect ratio microstructures. This fabrication process is based on the three well established technologies of vacuum deposition of metal films: conventional UV photolithography, and electrochemical deposition of metals and alloys. There is a growing interest in using this combination of these three technologies for device fabrication in a variety of applications.

The basic steps of this process start with a selected substrate material where the surface is metallized using vacuum deposition to create a plating base. A thick layer on the order of 15–200 microns of conventional UV photoresist is applied to the metallized surface. A desired two-dimensional pattern on the photoresist is exposed to a mercury vapor lamp through a mask. The photoresist is developed, forming a three-dimensional impression of the photomask pattern. The substrate is then put into an electroplating bath or an electrolyte solution where the photoresist molds the electrochemically deposited metal or alloy into a three-dimensional structure.

One of the problems encountered when using photoresist material to form molds for shaping electrochemically deposited metals or alloys is that unless the electrolyte and photoresist are compatible, ions of certain metals and alloys migrate through the interface between the photoresist and the plating base during plating. This is referred to as underplating and it occurs continuously during the electrodeposition, though at a much slower rate than the deposition itself. Due to this slower rate, for depositions of only 5 or 10 microns thickness, underplating may not be a difficult problem. But, the accumulation of underplated metal during a 15, 50, or 100 micron thick deposition often ruins the final structure.

To control underplating, photoresist used to mold thick electrochemically deposited metallic three-dimensional structures, there are two methods currently used. The first method utilizes or develops an electrolyte solution with chemical characteristics that control the underplating. The second method uses a low current density during electroplating to minimize the underplating rate.

Selecting an electrolyte solution based on its ability to control underplating often leads to numerous other problems to overcome. To begin with, the chemical properties of an electrolyte solution are a major determinant of the physical properties of the final deposited metallic object. It is preferable in many cases to select an electrolyte solution based on the desired properties of the deposited metallic object. Additionally, electrolyte solutions which are effective at controlling underplating can contain more hazardous chemicals than other solutions. Due to the increasing regulation of hazardous material shipment and disposal, the elimination of these chemicals from manufacturing processes is becoming a requirement for economically viable operations. And finally, an electrolyte solution which is effective at controlling underplating can often chemically attack the photoresist which forms the mold for shaping the electroplated metallic object. To use such a solution requires additional treatment of the photoresist to enable it to hold up during plating, which then leads to requiring more aggressive and potentially hazardous chemicals for removing the photoresist after plating.

Controlling the underplating of photoresist by using a low current density during electroplating is limited and sometimes inconsistent in the final results. It is believed that this method provides some control over underplating because a reduction in current density affects the underplating rate more than the plating rate. However, underplating is not eliminated with this method and can still cause major problems with thick electroplated structures. Additionally, reducing the plating rate makes electroplating thick structures an excessively slow process for industrial applications.

The underplating problem is not limited to situations where a thick resist layer is deposited on a metallic surface and a thick metallic interconnect is plated in the mold formed by the resist. U.S. Pat. No. 4,624,749 to Black et al discloses electrodeposition of submicron metallic interconnects for integrated circuits where the underplating problem is encountered. In order to reduce or eliminate the underplating between the resist and the metallic surface, the Black et al patent relies on the combination of toughening the resist skin and pulsing the electroplating current during the electroplating deposition of a metal or alloy

SUMMARY OF THE INVENTION

It is an object of this invention to improve adhesion between a metallic surface and a resist disposed thereon;

It is another object of this invention to reduce or eliminate underplating between a metallic surface and a resist disposed thereon which takes place during plating of a metallic material on the metallic surface adjacent the resist.

These and other objects of this invention are attained by providing a layer of a sacrificial material between a metallic surface and a resist disposed thereon to reduce or eliminate deposition of a metallic material between the metallic surface and the resist during electroplating deposition of the metallic material on the metallic surface adjacent the resist.

BRIEF DESCRIPTION OF THE DRAWINGS

A more complete appreciation of the subject invention can be obtained by reference to the detailed description of invention and the accompanying drawings in which like numerals in different figures represent the same structures or elements wherein.

DETAILED DESCRIPTION OF THE INVENTION

Figure 1:
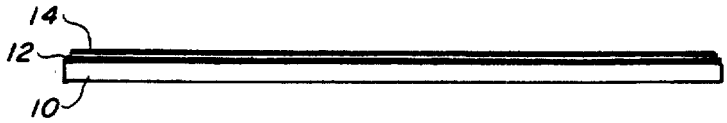
FIG. 1 shows a diagrammatic cross-section of a substrate layer with a plating base disposed over its upper surface and a layer of sacrificial material disposed over and being in contact with the plating base.

This invention pertains to a method of fabricating electronic microstructures wherein a sacrificial layer is applied onto a plating metallic base layer to promote adhesion between the plating base layer and the resist disposed above thus reducing or eliminating deposition of a metal or an alloy between the resist and the plating base layer during electrodeposition of the metal or the alloy.

The sacrificial layer adheres more tenaciously to the resist than does the plating base. The sacrificial layer thus reduces the tendency of the resist to separate from the sacrificial layer and allow deposition of metal or alloy during the electroplating. Adhesion of the sacrificial layer to the plating base layer is sufficient to prevent separation and deposition of the metal or alloy on the plating base.

The sacrificial material used between the interface of the plating base and the resist also acts as a protective coating during the resist processing. It is well known that after developing the resist, a thin scum layer of contamination remains on the substrate surface. This contamination is very difficult to remove, usually requiring an oxygen plasma ashing, which can cause other problems. Using the fabrication method described herein, the contamination adheres to the sacrificial material disposed between the plating base and the resist and is removed in the same selective etch with the sacrificial material, leaving a clean and contamination-free plating base surface. This is very significant as the condition of the plating base is a major determinant of the quality of the final electrochemical deposition.

Although the substrate can be any semiconductor, electro-optic or metallic material such as silicon, fused silica, gallium arsenide, indium phosphate, lithium niobate, lithium tantalate, or potassium titanium phosphate, the preferred substrate is lithium niobate. The substrate can be of any dimension, thickness or materials desired. The typical substrate is a semiconductor, however, the substrate used in the example is a dielectric disk of lithium niobate about 3 inches in diameter and about 500 microns thick. A number of microstructures can be formed on such a disk.

The fabricating method of the present invention includes the steps of depositing an adhesion layer on a cleaned substrate; depositing a plating base on the adhesion layer; depositing a sacrificial layer on the plating base; depositing a resist on the sacrificial layer; exposing, developing and removing the exposed and developed resist, thus uncovering a portion of the sacrificial layer; removing the uncovered sacrificial layer to uncover the plating base; plating a metallic object on the uncovered plating base; removing the unexposed and undeveloped resist disposed on the sacrificial layer; removing the sacrificial layer that is uncovered when the resist is removed; and removing the plating base that is uncovered when the sacrificial layer is removed.

The steps of depositing the adhesion layer, the plating base and the novel sacrificial layer on a suitable substrate are typically carried out by vacuum evaporation in a chamber, typically at a low vacuum and at about room temperature. The pressure in the chamber is on the order of $10^{-6}$ Torr. Thickness of the adhesion layer should be a minimum that promotes adhesion of the plating base to the substrate. In practice, the adhesion layer is a thin film of a few hundred angstroms thick, such as about 100–700 angstroms. Although any material can be used, typically, the adhesion layer is titanium, tantalum, chromium, nickel or tungsten. The various layers disposed directly or indirectly on the substrate usually includes the adhesion layer which is disposed on the substrate, the plating base which is disposed on the adhesion layer, and the sacrificial layer which is disposed on the plating base.

In certain applications, a barrier layer is provided between the substrate and the adhesion layer. For example, in fabricating electro-optic modulators, a thin film of silicon dioxide barrier layer is provided, typically by vacuum evaporation, to serve as a buffer between the metal above and the waveguides below.

The plating base is a metallic surface on which a metallic material can be deposited by electroplating from a plating solution under the action of an electrical current. Suitable plating base is a malleable, highly electrically conducting metallic material selected from metals and alloys. A typical plating base can be gold, silver, platinum, palladium, copper, aluminum or an alloy thereof or an alloy with different materials. Gold is the preferred plating base because of its superior signal conducting properties and its resistance to oxidation. Although the gold plating base can be any desired thickness, typically its thickness is on the order of less than 1 micron.

The novel sacrificial layer can be any metallic material that promotes adhesion between the plating base and the resist that is deposited above. This layer reduces or eliminates underplating that typically takes place during electroplating deposition of a metallic material in the form of deposition of the metallic material on the plating base between the plating base and the resist disposed thereon. Although the preferred sacrificial layer is titanium, it can be tantalum, chromium, nickel or tungsten and mixtures thereof. Thickness of the sacrificial layer should be such as to reduce or eliminate underplating and typically it is below 1 micron, more typically a few hundred angstroms, such as about 200–700 angstroms.

If thickness of the sacrificial layer is too thin, such as below about 50 angstroms, then it will not be effective to reduce or prevent underplating, however, if this thickness is too great, such as in excess of about 0.5 microns, then no additional advantage is achieved.

Before depositing a resist on the sacrificial layer, the resulting structures are typically dehydration baked to promote adhesion between the sacrificial layer and the resist disposed thereabove. This dehydration bake is accomplished by placing the structure in an ordinary gravity oven maintained at appropriate temperatures and duration to remove surface moisture. Typically, this temperature is in the approximate range of 100°–200° C. and duration is a 10 hours or less, particularly in the approximate range of 0.5–4 hours. Although higher temperature will reduce duration, the temperature must not be so high as to damage any aspect of the plating base.

FIG. 1 illustrates planar substrate 10 with planar plating base 12 disposed on the substrate and planar sacrificial layer 14 disposed on the plating base.

When the substrate is cool enough from the dehydration bake step, the step of depositing a conventional resist on the sacrificial layer is carried out in a known manner. The resist can be applied in more than one layer to build up the resist thickness. After each resist is deposited on the sacrificial layer, the resist can be hardened in an oven.

The conventional way of depositing a resist on a substrate is by puddling a small amount thereof in the middle of the substrate and then spinning the substrate at a predetermined rpm to deposit the desired thickness of the resist. This procedure can be repeated to incrementally build up the desired thickness. This procedure typically results in an edgebead which is removed to maintain a planar layer of the resist on the substrate.

To activate the resist so that it can be suitably exposed, the structure is pre-exposure baked at an elevated temperature to activate a photo-active compound in the resist. Typically, this is accomplished by placing the substrate with the resist thereon on a hotplate and heating it from about room temperature to an elevated temperature below about 100° C. To achieve the photosensitivity necessary to expose a thick layer, i.e., greater than about 10 microns, of a photoresist, the resist on the substrate is hydrated by keeping it in a humid atmosphere so that it absorbs sufficient water vapor. Typically, hydration of the photoresist can be accomplished at a relative humidity of about 45% and a holdtime of less than a few hours, such as about 1 to a couple of hours.

Any suitable resist can be used, including positive and negative resists. Although positive, novolac-based photoresists are preferred, others can also be used especially if exposure is effected with x-rays rather than photons. Vertical and horizontal extent of the resist deposits on the sacrificial layer depend on the particular application contemplated for the finished product. In fabricating integrated circuits where metallic material lines are typically submicron in thickness and width, it is necessary that width and height of the unexposed resist be also submicron, however, in certain modulators, the plating object may be in excess of 10 μm thick, requiring a thicker resist. Generally speaking, in the context of the invention disclosed herein, resist thickness can vary from submicron to 200 microns, but more typically, thickness of the resist is in excess of about 10 microns, such as 10 to 200 microns, especially 15 to 50 microns. The underplating problem addressed by the present invention is more pronounced with thicker resists, such as 10 to 20 microns.

After hydration, the steps of exposing the resist through a mask, developing and removing it are carried out. Exposure can be effected with light or another source of energy, such as x-rays. Typically, exposure of the resist is accomplished with light provided by a high pressure mercury vapor lamp and the exposure duration is just long enough to achieve complete photochemical reaction in the desired areas.

The exposed resist is then developed and removed in the open spaces corresponding to the pattern of the mask uncovering at least one portion of the sacrificial layer. Development of the exposed resist is typically accomplished by immersing the substrate with the resist thereon in a suitable developing solution for several minutes or spraying the developing solution across the substrate surface until all of the exposed resist has been dissolved and removed. After developing and removing the resist, the structure with the resist thereon is rinsed in deionized water, blow dried with a dry gas and subjected to microscopic examination to ascertain the character and condition of the unexposed resist on the structure.

After exposure, development, removal and microscopic inspection of the resist, the resist is treated to stabilize it against thermal flow. This is typically accomplished with reactive ion etcher by subjecting the unexposed resist on the structure to a plasma for up to several minutes.

The stabilized resist on the structure is then hardbaked to drive-off any residual solvent in the resist and to improve adhesion of the unexposed resist to the sacrificial layer on which it is disposed. Typically, this is conventionally accomplished in an oven or on a hot plate in less than 24 hours.

Figure 2:
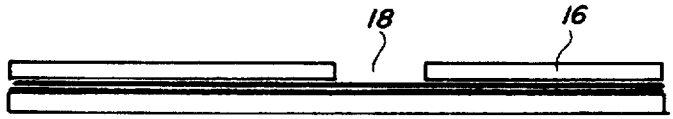
FIG. 2 shows a resist disposed over and being in contact with the sacrificial layer, a portion of the resist having been exposed, developed and removed leaving a space.

FIG. 2 illustrates the structure after removal of the exposed and developed resist and space 18 created in place of the removed resist showing uncovered sacrificial layer. Numeral 16 in FIG. 2 denotes resist.

The novel step of removing the uncovered sacrificial layer in the space is done to uncover the plating base 12 on which a metallic material in the form of a metallic structure 20 is deposited from a plating solution. Removal of the uncovered sacrificial layer 14 is typically effected with an appropriate chemical or plasma etching process. It should be, however, understood than any etching technique can be used which is effective in disintegrating the sacrificial layer without damaging plating base 12.

Figure 3:
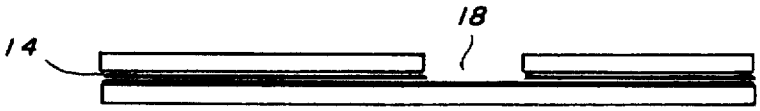
FIG. 3 is the same as FIG. 2 with the sacrificial layer removed in the space.

FIG. 3 illustrates the structure after removal of sacrificial layer 14 in space or micromold 18.

Since the next step in the fabrication method is electroplating, selected areas of the unexposed resist are removed along the edge of the structure in order to provide electrical contacts to the plating base.

Deposition of a metallic material is accomplished in a known manner by immersing the structure and the unexposed resist thereon in a plating solution and depositing metallic material 20 under influence of an electrical current on the plating base in space 18 created after removal of the exposed resist. The space 18 is also referred to as an open-ended micromold since it serves to confine deposition of the metallic material as a mold does in a conventional molding operation. Electro-deposition of metallic material 20 is conducted in a conventional manner by attaching one portion of the structure with the unexposed resist thereon to the cathode side of a DC electrical power supply and another portion to the anode side of the power supply and plating the metallic material in the form of metallic object 20 on the plating base to the desired thickness.

Plating rate can be increased by heating the plating solution to an elevated temperature, typically below 100° C., such as between 40° and 80° C. A certain minimum temperature dependent current density is required in order to initiate electroplating. Although the minimum current density is a variable which depends on many parameters, typically, current density below about 0.1 $mA/cm^2$ fails to produce meaningful plating. For purposes herein, current density of below about 5 $mA/cm^2$, and especially 0.5–2 $mA/cm^2$, typically suffices to plate the metallic materials of an acceptable character and at an acceptable rate. It is contemplated that plating of the metallic material of desired thickness will take less than several days, typically on the order of 20 hours or less.

Thickness of the plated object can vary greatly depending on what is desired. It can be submicron if only an interconnect structure is desired but it can be much thicker for other applications such as novel sensor designs, fiber optic connectors and devices, microcoils for electronics applications, microparts for micromachines, and even microsized electric motors. Sufficient to say, it is contemplated that thickness of the plating object can be in excess of 200 microns although typically, this thickness is from submicron to below 200 microns, especially in the range of 5–50 microns. The width of the plated metallic object is typically less than its thickness and more typically, it is 3 to 30 μm.

Figure 4:
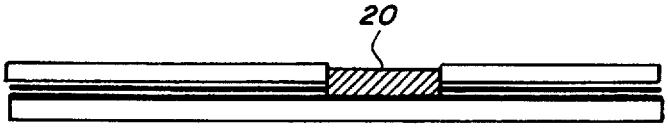
FIG. 4 is the same as FIG. 3 with a metallic object plated on the plating base in the space.

FIG. 4 shows the substrate with plated object 20 disposed in space 18, the plated object being composed of a metallic material that can be same or different from metallic layer 12. The top surface of plated object 20 is typically below the top surface of resist 16.

After the electroplating operation is complete, the microstructure is removed from the plating bath and the steps of removing the unexposed and undeveloped resist, the sacrificial layer, the plating base and the adhesion layer are carried out sequentially. The resist disposed on the sacrificial layer is unexposed resist which is removed in a known manner, as by dissolving it in a common solvent, such as acetone. After removing the resist, what is uncovered is the sacrificial layer which is disposed on the plating base which, in turn, is disposed on the adhesion layer which in turn, is disposed on the barrier layer, which, in turn, is disposed on the substrate. The uncovered portions of the sacrificial layer, the plating base therebeneath and the adhesion layer beneath the plating base are removed in a known way. The plated object remains disposed on a portion of the plating base. The plating base remaining on the substrate and is coextensive with the plated object disposed directly above.

Figure 5:
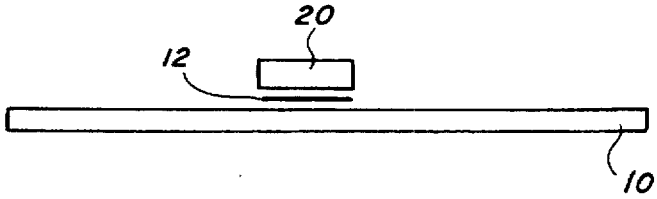
FIG. 5 shows the metallic object disposed in the space on the substrate with the plating base and all of the resist, sacrificial layer, and the base layer removed outside of the metallic object.

FIG. 5 illustrates plated object 20 disposed on plating base 12 which in turn is disposed on substrate 10.

The invention having been generally described, the following example is given as a particular embodiment of the invention to demonstrate the practice and advantages thereof. It is understood that the example is given by way of illustration and is not intended to limit in any manner the specification or the claims that follow.

EXAMPLE

This example demonstrates the fabrication method disclosed herein after high speed, i.e., above GHz, electro-optic modulators have been formed by infusing waveguides in a lithium niobate substrate. The substrate was a Z-cut disk 3" in diameter and 0.5 millimeters thick which was cleaned by a standard cleaning procedure.

The surface of the substrate was then sputter coated from a 5" silicon dioxide target at a pressure of $6–7\times10^{-3}$ Torr using RF power of 150 watts. The silicon dioxide thin film coating was 0.9 micron thick and was deposited on the lithium niobate substrate as a barrier layer to separate the waveguide below from the structure above. The silicon dioxide coating was then cleaned by the standard cleaning procedure.

The substrate was sequentially coated in situ with three separate films in an electron beam evaporator with the first being the titanium adhesion layer about 200 Å thick, the second being the gold plating base about 1500 Å thick, and the third being the novel titanium sacrificial layer about 500 Å thick. The coated substrate was then dehydration baked in a gravity oven at 150° C. for about 2 hours to remove surface moisture.

After cooling the coated substrate, AZ 4620 positive, novalac photoresist was applied by puddling about 2 ml thereof in the center of the coated substrate on the sacrificial layer and spinning the substrate at 2000 rpm for 30 seconds to provide a first resist layer on the substrate. The resist is characterized by the presence of the diazonaphthoquinone sulfonic acid photoinitiator. The first resist layer was slightly hardened by placing the coated substrate in a convection oven at 90° C. for 3 minutes. A second layer of the resist was applied as was the first and then hardened in the same way to produce a total resist thickness of 24 μm. The formed resist edgebead was removed manually using a foam-tipped swab soaked in acetone.

The coated substrate consisting of the silicon dioxide barrier layer on the substrate, the titanium adhesion layer disposed on the barrier layer, the gold plating base disposed on the adhesion layer, the titanium sacrificial layer disposed on the plating base and the photoresist disposed on the sacrificial layer, was pre-exposure baked on a hot plate for 360 seconds at 110° C., and allowed to stand for 20 minutes to permit the photoresist to absorb water vapor.

The coated substrate was then exposed by placing a 4"×4" quartz plate mask with a desired pattern in a thin chromium film on the top surface of the resist and projecting onto and through the mask for about 60 seconds all wavelengths of a 350 W high pressure mercury vapor lamp with the "H" line (405 nm) reading about 17 mW/cm$^2$ intensity. The exposed resist on the microstructure was then developed and removed in about 4 minutes in a 4:1 mixture of deionized water and the resist developer, rinsed with deionized water, blow-dried with dry nitrogen and subjected to microscopic inspection to determine character of the unexposed resist which now formed a micromold around the space where the exposed resist was removed.

After developing, rinsing, blow drying and microscopic inspection, the unexposed resist on the microstructure was subjected to the PRIST treatment to stabilize the resist against thermal flow. The coated substrate was placed in a reactive ion etcher (RIE) and treated with plasma (150 m Torr helium and 50 m Torr carbon tetrafluoride, 50 watts power for 45 seconds) to harden the photoresist. The plasma hardened coated substrate was hardbaked in a convection oven for 1 hour at 110° C. The oven was initially cool and was turned on after the coated substrate was inserted. The coated substrate was allowed to slowly cool to room temperature before being removed from the oven, which took at least about 120 minutes.

Next, the titanium sacrificial layer was removed in the area that was to be electroplated by submerging the microstructure in an ethylenediaminetetraacetic acid (EDTA) etching solution having the following composition:

deionized water—200 ml
30% hydrogen peroxide—17 ml
ammonium hydroxide—9 ml
EDTA powder—10 g The titanium sacrificial layer was removed by placing the microstructure in the EDTA etching solution for about 5–10 minutes with some agitation.

In preparation for the electroplating procedure, the resist was removed from the periphery at the opposite sides of the microstructure at selected areas to serve as electrical contacts. Removal of the resist was done with acetone soaked and methanol soaked swabs.

Before electroplating was commenced, the Sel-Rex 402 gold electroplating solution containing cyanide gold complex was heated to 50°–60° C. and stirred with a magnetic rod to accelerate plating. The microstructure was clipped on the electrical contact areas to the anode and cathode sides of a DC power supply and lowered into the plating solution. The current from the power supply was slowly increased to the current density of about 1 mA/cm$^2$ and the microstructure was kept in the plating solution for about 6 hours to deposit a gold plating object 16 μm thick and 8 μm wide.

After completing electroplating, the resist around the plating object was removed using acetone, the titanium sacrificial layer was removed using the EDTA etching solution, the gold plating base was removed with an iodine etching solution, and the titanium adhesion layer was also removed with the EDTA etching solution. The iodine etching solution that was used to remove the gold plating base had the following composition:

ethyl alcohol—400 ml
dionized water—40 ml
iodine crystals—40 g
potassium iodide crystals—24 g After removal of the various layers, the gold plating object remained on the remaining strip of the sacrificial layer which in turn was disposed on the remaining strip of the plating base which in turn was disposed on the remaining strip of the adhesion layer which in turn was disposed on the lithium niobate substrate coated with silicon dioxide.

Many modifications and variation of the present invention are possible in light of the above teachings. It is, therefore, to be understood that within the scope of the appended claims, the invention may be practiced otherwise than as specifically described herein.

What we claim is:

1. A method for reducing or eliminating underplating without an adhesion promoter, the underplating being between a plating base and a resist layer disposed thereabove comprising the steps of:

(a) providing a sacrificial layer between the plating base and the resist layer;

(b) exposing and completely removing the resist layer from at least one selected area, leaving a remaining portion of said resist layer disposed on the sacrificial layer outside of the at least one selected area, and uncovered sacrificial layer disposed over the plating base;

(c) removing the uncovered sacrificial layer from the at least one selected area, thus uncovering a portion of the plating base;

(d) depositing a metallic material on said uncovered plating base, where deposition of the metallic material on the plating base between the plating base and the sacrificial layer outside of the at least one selected area is eliminated or reduced compared to deposition of the metallic material in absence of the sacrificial layer; and (e) removing the remaining resist layer and the sacrificial layer.

2. The method of claim 1 wherein thickness of the resist layer is from submicron to about 200 microns.

3. The method of claim 1 wherein the resist is an ultraviolet photoresist, thickness of the resist is in the approximate range of 10 to 200 microns, and the sacrificial layer is composed of a material selected from the group consisting of titanium, tantalum, chromium, nickel, tungsten, mixtures thereof.

4. The method of claim 1 wherein the resist is ultraviolet photoresist, thickness of the resist is in the approximate range of 15 to 50 microns, the sacrificial layer comprises a material selected from the group consisting of titanium, tantalum, chromium, nickel, tungsten and mixtures thereof.

5. The method of claim 4 wherein said step of removing the sacrificial layer is effected with a chemical or plasma etching process.

6. The method of claim 3 wherein said step of providing the sacrificial layer on the plating base is effected by means of electron beam evaporative coating.

7. The method of claim 6 wherein thickness of the sacrificial layer is below about 1 micron.

8. The method of claim 7 wherein the metallic material that is electrodeposited on the plating base is selected from the group consisting of gold, platinum, palladium, copper, aluminum, and mixtures thereof.

9. The method of claim 4 therein the metallic material is gold and the sacrificial layer is titanium.

10. The method of claim 2 wherein the plating base is a submicron thick gold layer and where in said depositing step is effected under the influence of electrical current from a plating solution containing a cyanide gold complex to deposit gold of a thickness in the approximate range of about 5 to 50 microns and of width in the approximate range of 3 to 30 microns.

11. The method of claim 10 wherein said step of providing the sacrificial layer on the plating base is effected by means of electron beam evaporate coating, the sacrificial layer is titanium less than 1 micron thick.

12. A method of fabricating a microstructure comprising the steps of:

(a) depositing an adhesion layer directly or indirectly on a substrate;

(b) depositing a plating base directly on the adhesion layer;

(c) depositing a sacrificial layer directly on the plating base, said sacrificial layer comprising a material that reduces or eliminates underplating on the plating base compared to underplating in absence of the sacrificial layer;

(d) depositing a photoresist directly on the sacrificial layer;

(e) exposing, developing and removing the exposed photoresist from at least one selected area leaving unexposed photoresist layer disposed on the sacrificial layer outside of the at least one selected area and the at least one selected area devoid of the exposed photoresist;

(f) removing the sacrificial layer from the at least one selected area thus uncovering the plating base in the at least one selected area;

(g) depositing a metallic material on the uncovered plating base on the at least one selected area under the influence of electrical current whereby deposition of the metallic material on the plating base between the plating base and the sacrificial layer outside of the at least one selected area is eliminated or reduced compared to deposition of the metallic material in absence of the sacrificial layer; and (h) removing the remaining resist layer and the sacrificial layer.

13. The method of claim 12 wherein thickness of the photoresist is from submicron to about 200 microns.

14. The method of claim 12 wherein thickness of the photoresist is in the approximate range of 10 to 200 microns and the sacrificial layer comprises a material selected from the group consisting of titanium, tantalum, chromium, nickel, tungsten, and mixtures thereof.

15. The method of claim 14 wherein the photoresist is a novolac-based positive photoresist wherein said exposing step is effected through a mask with light of a wavelength in the ultraviolet region.

16. The method of claim 15 wherein said step of removing the sacrificial layer is effected with a chemical or plasma etching process.

17. The method of claim 16 wherein said step of providing the sacrificial layer on the plating base is effected by means of electron beam evaporative coating and wherein thickness of the sacrificial layer is below about 1 micron.

18. The method of claim 17 wherein the metallic material that is electrodeposited on the plating base is selected from the group consisting of gold, platinum, palladium, copper, aluminum, mixtures thereof and mixtures with other substances.

19. The method of claim 18 wherein said depositing step is effected from a plating solution containing a cyanide gold complex and the substrate is selected from the group consisting of silicon, fused silica, gallium arsenide, lithium niobate, lithium tantalate, potassium titanium phosphate and mixtures thereof.

20. The method of claim 19 wherein the sacrificial layer is submicron thick titanium, the plating base is a submicron thick gold, the metallic material is gold about 5–50 μm thick, and the substrate is selected from the group consisting of lithium niobate, lithium tantalate, potassium titanium phosphate and mixtures thereof.

21. Product made by the method of claim 1.

22. Product made by the method of claim 11.

23. Product made by the method of claim 12.

24. Product made by the method of claim 20.

* * * * *